United States Patent [19]

Salete

[11] 4,167,478

[45] Sep. 11, 1979

[54] UNIVERSAL MODULAR SCREENING, CLASSIFYING, CLEANING AND SIZING MACHINE

[76] Inventor: Felipe Salete, P.O. Box M-9989, Mexico 1, D.F., Mexico

[21] Appl. No.: 842,206

[22] Filed: Oct. 14, 1977

Related U.S. Application Data

[63] Continuation of Ser. No. 636,477, Dec. 1, 1975, abandoned.

[30] Foreign Application Priority Data

Sep. 24, 1975 [MX] Mexico ..... 160881

[51] Int. Cl.[2] ..... B07B 1/36

[52] U.S. Cl. ..... 209/331; 209/366.5; 209/318; 209/363

[58] Field of Search ..... 209/36, 28, 37, 325, 209/315, 326, 318, 366, 366.5, 367, 332, 365 R, 365 B, 331, 240; 74/87

[56] References Cited

U.S. PATENT DOCUMENTS

| | | | |
|---|---|---|---|
| 626,160 | 5/1879 | Haag | 209/36 X |
| 689,258 | 12/1901 | Walter | 209/28 |
| 1,038,124 | 9/1912 | Halladay | 209/366 |
| 1,685,942 | 10/1928 | Deister | 209/367 X |
| 1,870,629 | 8/1932 | Ingraham | 209/332 X |
| 2,222,299 | 11/1940 | Parks | 209/365 B |
| 2,528,626 | 11/1950 | Stroud | 209/326 X |
| 2,579,496 | 6/1952 | Soldan | 209/366.5 X |
| 2,705,561 | 4/1955 | Denovan | 209/332 |
| 2,804,967 | 9/1957 | Myslop | 209/367 X |
| 2,899,044 | 8/1959 | Allen | 74/87 X |
| 2,902,868 | 9/1959 | Ferrara | 74/87 |
| 2,994,431 | 8/1961 | Becker | 209/367 |
| 3,101,315 | 8/1963 | Denovan | 209/332 |
| 3,123,552 | 3/1964 | Lowry | 209/326 |
| 3,356,214 | 12/1967 | Johnson | 209/332 X |
| 3,380,585 | 4/1968 | Salete | 209/37 |
| 3,422,955 | 1/1969 | Mock | 209/332 X |

FOREIGN PATENT DOCUMENTS

| | | | |
|---|---|---|---|
| 2047011 | 3/1972 | Fed. Rep. of Germany | 209/315 |

*Primary Examiner*—Robert Halper

*Attorney, Agent, or Firm*—Ladas, Parry, Von Gehr, Goldsmith & Deschamps

[57] ABSTRACT

A universal modular screening, classifying, cleaning and sizing machine for dusty material, comprising a frame which supports a screen box by means of cables permitting the free oscillation of the box; the screen box containing spaced parallel screens and having passages for the material to enter the screen box and to discharge same at various levels, including air flow entry and outlet channels, and at the bottom of the screen box, a mechanism to produce the oscillation of the screen box; wherein the mechanism for producing oscillation of the screen box is composed of overlying counterweights which are capable of being moved relative to one another, opening and closing in the manner of a fan, releasably clamped between a holder which is driven at variable speed and a rotating hub whose support shaft is fixedly attached to the bottom of the screen box and the oscillating mechanism is located away from the center of gravity of the screen box at the head of the machine toward the material infeed, producing an oscillation of the screen box in such a way that as the material enters an elliptical movement is produced transverse to the long axis of the machine, and progressively reducing the elliptical movement down the length of the machine to generate further along, longitudinal elliptical movement and at the end, a rectilinear reciprocating movement toward the discharge of the material.

3 Claims, 8 Drawing Figures

UNIVERSAL MODULAR SCREENING, CLASSIFYING, CLEANING AND SIZING MACHINE

CROSS-REFERENCE TO RELATED APPLICATION

This is a continuation of co-pending application Ser. No. 636,477 filed Dec. 1, 1975, now abandoned.

BACKGROUND OF THE INVENTION

This invention refers in general to machines for cleaning or classifying, sizing or screening grains, seeds, granular and powdery material, and more particularly concerns to improvements in a universal modular screening, classifying, cleaning and sizing machine which is adaptable to the conditions of each individual product, whether it be powdery, granular, vegetable or mineral, by means of regulating at will the stroke and frequency of the oscillation.

Up to the present time there has not been a universal machine which encompasses or covers the different processes of cleaning, sizing, classifying, etc. of various products as efficiently for each particular product as a machine specifically designed and built for a single one of the objectives mentioned.

At the present time there are very diverse types of machines designed and manufactured for each of the objectives indicated, but they are so specialized that the one used for cleaning grains is not suited for classifying seed for planting, nor will a machine for this purpose serve to sift powdery or floury products, nor is it suitable for separating minerals, and so forth.

For each one of these indicated operations a different oscillation and a different frequency of oscillation is required, ranging from a particular rectilinear oscillatory movement of the screens for certain specific cases to a rotary movement of the screens.

The best solutions have been obtained up to the present time in machines able to produce different kinds of oscillations ranging from circular movement at the point of delivery of the material to straight-line movement at the material discharge. However, this type of oscillation is obtained in fixed mechanisms machines with fixed stroke and frequency which transmit severe trepidation to their own structure, causing problems in mounting them because of the need for insulating them to prevent the transmission of such shaking to other machinery, as well as the resulting wear and deterioration which such continuous shaking produces in a machine. Furthermore, this kind of shaking makes its impossible to stack two or more of these machines in order to obtain the combination of operations required for the treatment of a product or material which is to be cleaned, screened, classified, sized or separated.

This latter type of machine, in addition to the drawbacks cited, can be easily differentiated from the one which is the object of the present invention by the fact that the oscillation is obtained by means of a fixed mechanism, that is, it is not of the freely oscillating type, to which the present invention belongs, preventing the posibility of frequency and stroke lenght modification.

SUMMARY OF THE INVENTION

In view of the foregoing it is an object of this invention to provide a universal modular screening, classifying, cleaning and sizing machine for cleaning, separating and selecting various classes of products, characterized in that it gives to the screen a free oscillation of a transversely elliptical trajectory at the end where the material is fed in and a rectilinear trajectory at the discharge end, relative to the long axis of the machine.

Another object of this invention consists of providing a universal modular screening, classifying, cleaning and sizing machine which includes an ajustable counterbalance mechanism having free rotation in a horizontal plane, located beneath the screen, placed away from the center of gravity of the machine, close to the end where the material is fed in.

Another object of this invention is to provide a universal modular screening, classifying, cleaning and sizing machine in which the mechanism which imparts the oscillating movement to the screen can be regulated to obtain a longer or shorter stroke or eccentricity of the elliptical oscillation, according to whether the counterweights are moved farther from or closer to their center of gravity in relation to the longitudinal axis of the screen box.

Still another object of this invention is to provide a universal modular screening, classifying, cleaning and sizing machine in which the motor driving the counterweights which impart the oscillatory movement to the screen is mounted on the screen frame, and includes a transmission composed of multiple speed pulleys having various diameters to modify the frequency of the oscillation, that is, to vary the RPM according to the desired stroke of of the screen.

A further object of this invention is to provide a universal modular screening, classifying, cleaning and sizing machine having free oscillation, that is to say, where the screen is supported by means of free suspension from a frame so that no shaking or vibration is transmitted to the frame, which permits of mounting one similar machine over another without increasing the vibration or shaking, whereby it is possible to obtain a very large number of possible combinations, using screens having better prefabricated mesh, and take advantage of the possibility of adding air lift modules at feed intakes and outlets.

These and other objects which will become apparent are achieved by the present invention as described in this specification, taken together with the accompanying drawings of the preferred embodiment of the invention.

DETAILED DESCRIPTION OF THE DRAWINGS

FIG. 5, is a detailed view in lengthwise section showing the disposition of the counterweights and variable speed drive pulleys for the counterweights, near the end of the machine where the material to be processed is fed in.

DETAILED DESCRIPTION OF THE INVENTION

Figure 1:
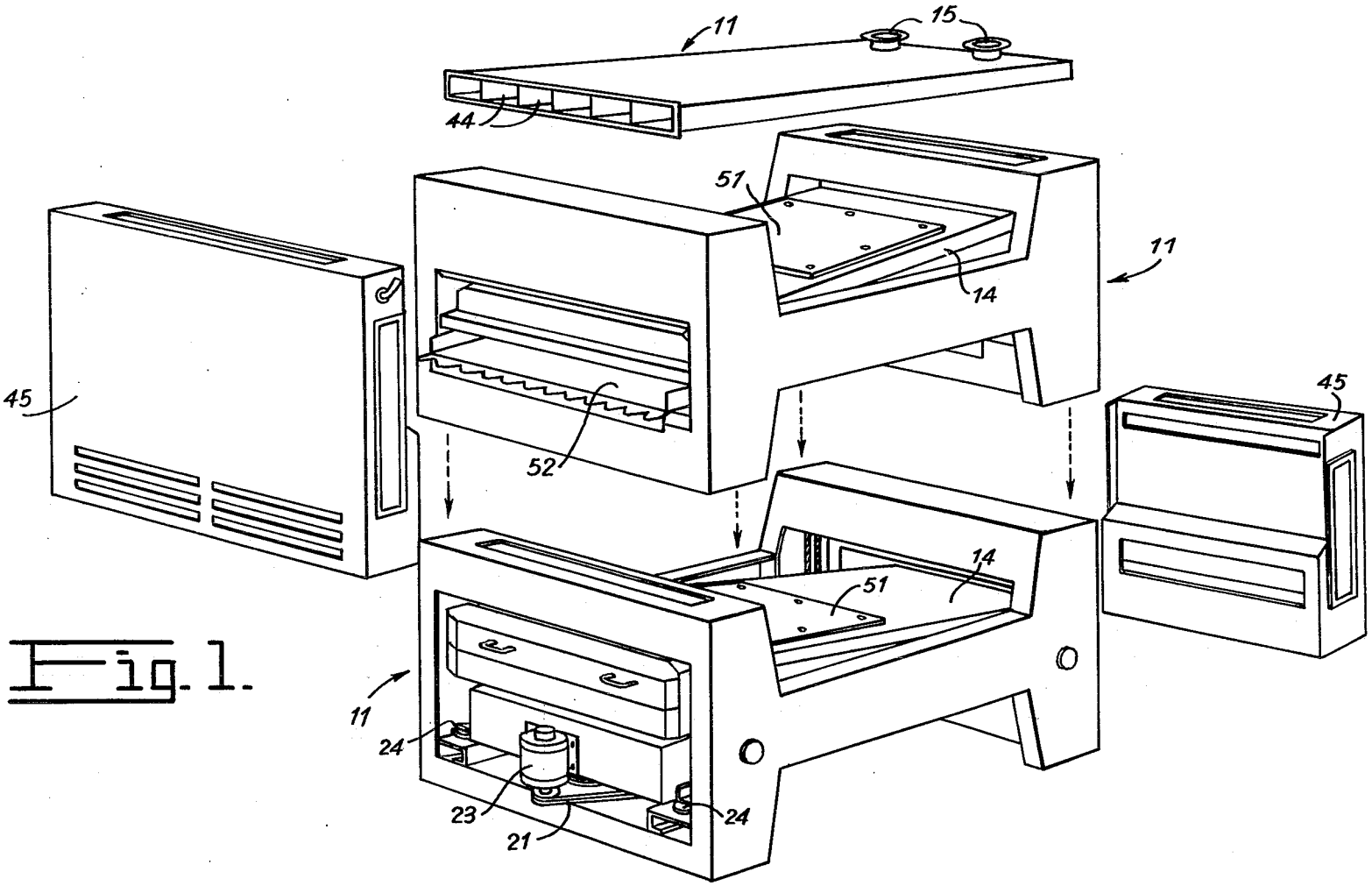
FIG. 1, is a conventional perspective view showing a universal modular screening, classifying, cleaning and sizing machine and showing how it can be mounted upon another similar machine as well as the possibility of installing air lift modules in the product inlets and outlets.

Referring now to the drawings, the universal modular screening, classifying and sizing machine 11 of the present invention is composed of a frame 12, from which hangs oscillating screen box 14 supported by cables 13; it receives the material to be processed introduced through feed orifices 15. Said screen box 14 as known, consists essentially of a closed shallow box having screens 46 or perforated metal sheets mounted within parallel to its upper and lower decks and secured to its sides and ends, the screen allowing grains or powder material smaller than its orifices to fall through and rejecting larger grains or material, thus separating the feed material into two or more products of different size ranges at discharge; it has orifices to admit the feed, and other orifices for discharging the screened material; the enclosure serves to prevent escape of dust and fine particles which might be otherwise lost as material is shaken.

Figure 8:
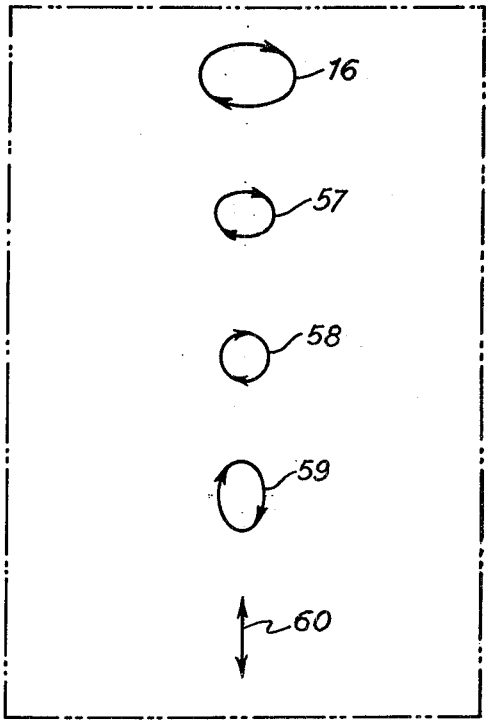
FIG. 8 is a schematic view illustrating in plan view the improved machine of the present invention, the barbed lines indicating the variations in oscillation which are obtained, going from transverse elliptical oscillation at the feed end to reciprocating rectilinear longitudinal movement at the discharge.

Said screen box 14, as is schematically indicated in FIG. 8, describes as it oscillates an elliptical transverse trajectory at its head where the materials are fed in, as shown by the barbed ellipse 16. This oscillation is generated by the counterweights 17 and 18 mounted one upon the other and which can be moved apart like a fan to regulate the eccentricity or travel of the elliptical movement shown, with the barbed ellipses of FIG. 8, corresponding to the oscillating travel of the screen. This elliptical movement of the screen box represented by ellipse 16 progressively reduces its eccentricity or transverse travel down the length of the screen, as can be appreciated by barbed ellipse 57, and at a certain point along the long axis of the screen box it becomes a circular movement represented in FIG. 8 with barbed circle 58; the elliptical movement continues to become less eccentric until it inverts its major and minor axes and becomes an elliptical movement having lengthwise eccentricity as illustrated in longitudinal barbed ellipse 59, and the elliptical movement continues to close until it becomes rectilinear reciprocating movement as illustrated in barbed line 60, near the discharge end of the screen box. These oscillating movements above described and illustrated with reference numbers 16, 57, 58, 59 and 60, represent the ideal for a screening and sizing mechanism, since at the infeed end thereof a transverse movement is produced to scatter the material, and at the discharge a lengthwise straight-line movement is produced to intensify the screening or sizing action. The maximum eccentricity of the oscillating movement of the mechanism of the present invention occurs when counterweights 17 and 18 are overlapped and registering, since their center of gravity will be farthest out of phase with relation to the lengthwise axis of the machine. As these counterweights 17 and 18 are spread apart fanwise the eccentricity of the oscillation diminishes and accordingly the travel of the screen box is also reduced. To move counterweights 17 and 18 relative to one another screws 19 holding pulley 20 are loosened. Pulley 20 is connected by means of belt 21 to drive pulley 22 mounted on the shaft of motor 23 which is fixedly secured to the box screen 14; this is a variable speed drive which makes it possible to vary the speed of counterweights 17 and 18 and thereby the frequency of oscillation of screen box 14. Thus, there is provided regulating movement both for the travel of the screen box depending on the position of counterweights 17 and 18 and for its frequency determined by the variable speed afforded by pulleys 20 and 22.

Figure 3:
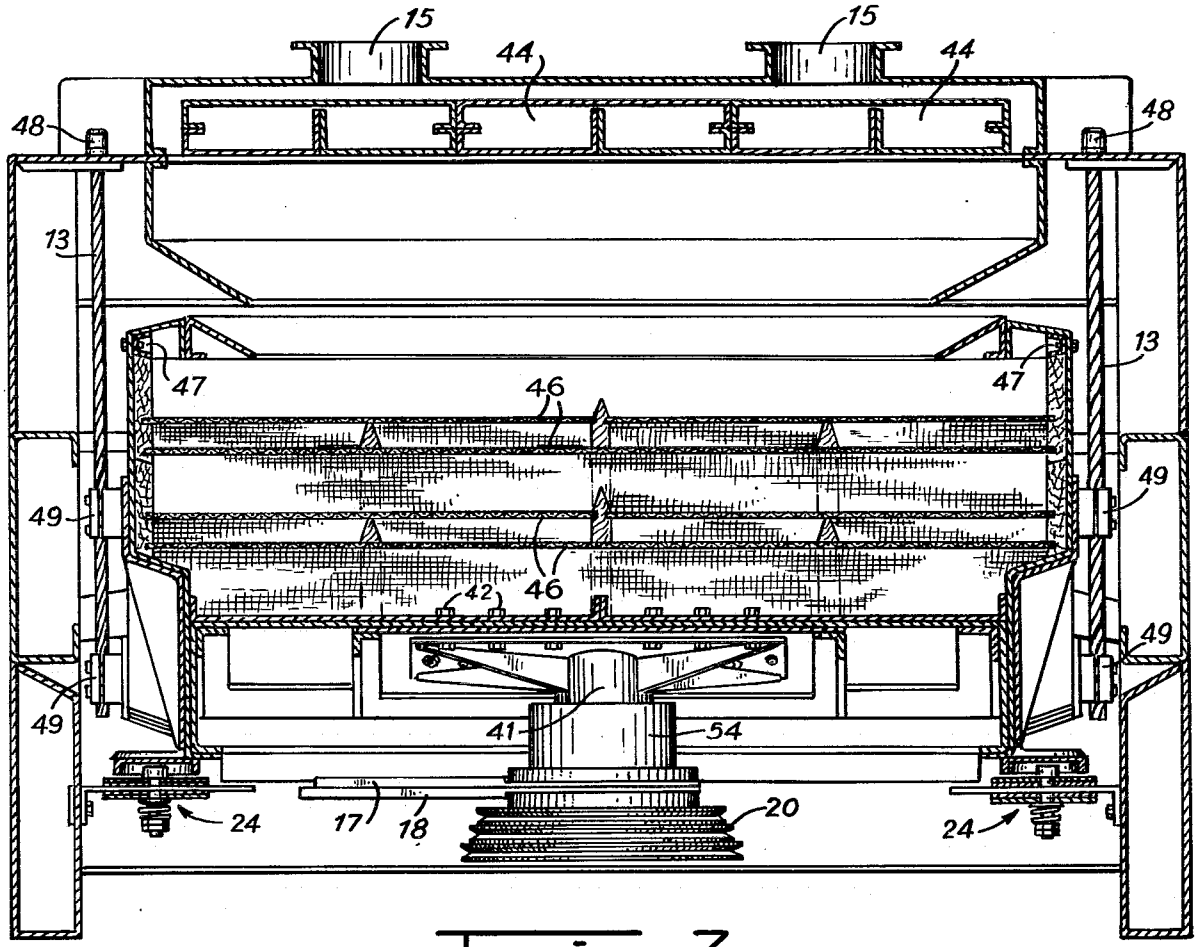
FIG. 3, is a conventional cross-section view of the machine of the present invention shown in FIGS. 1 and 2.
Figure 4:
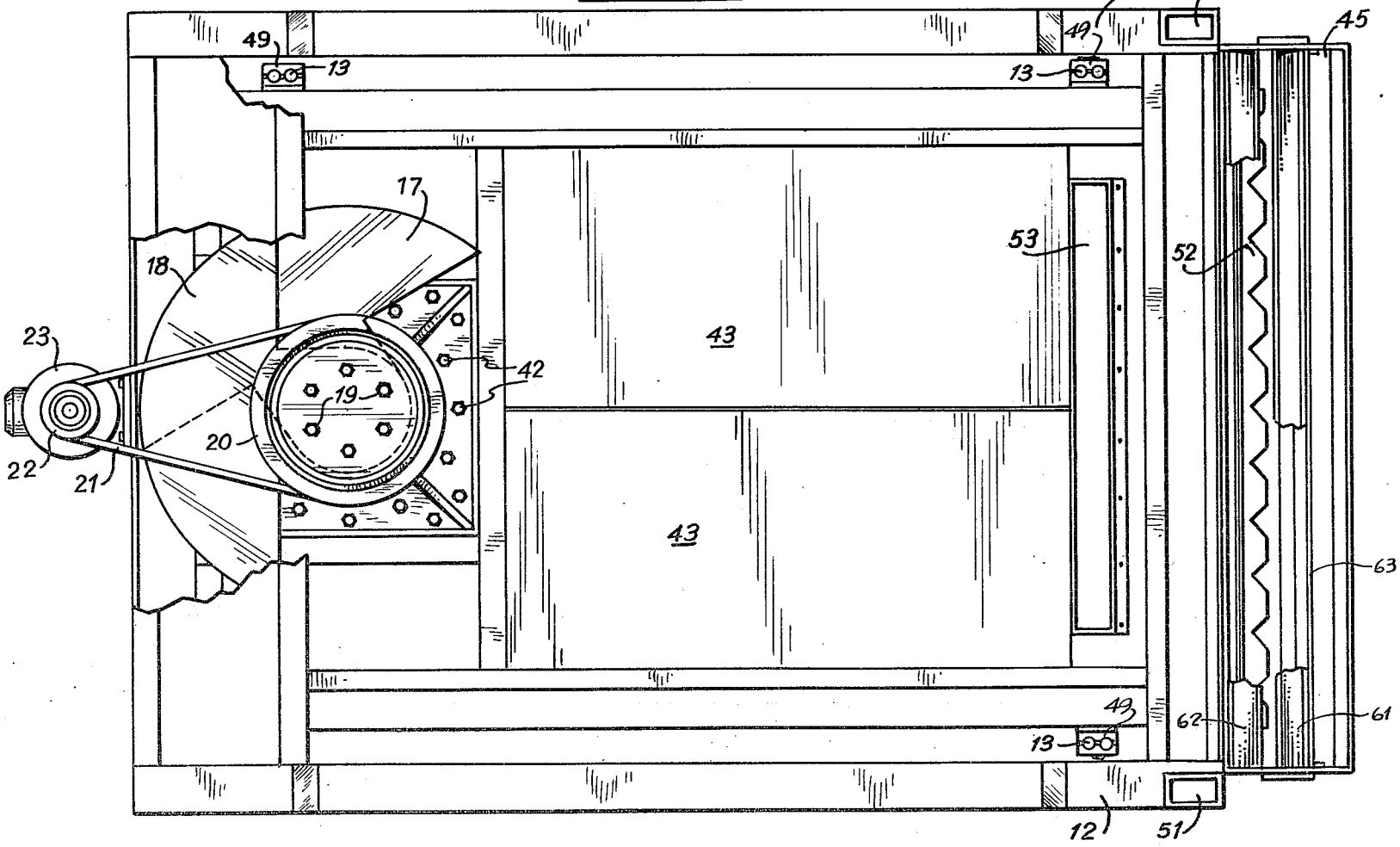
FIG. 4, is a bottom plan view with conventional sections of the machine of the present invention illustrated in the preceding Figures.
Figure 5:
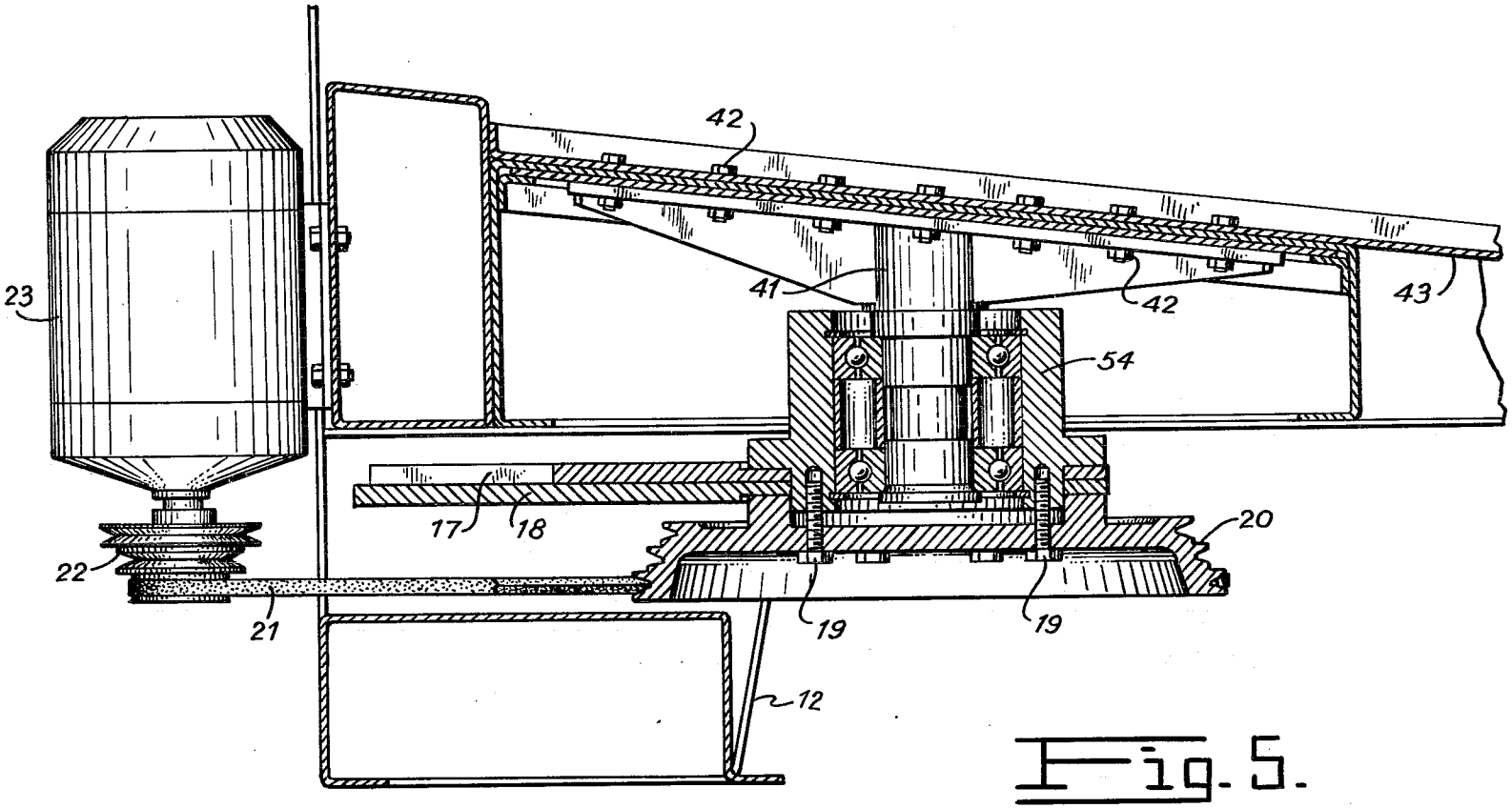
Figure 6:
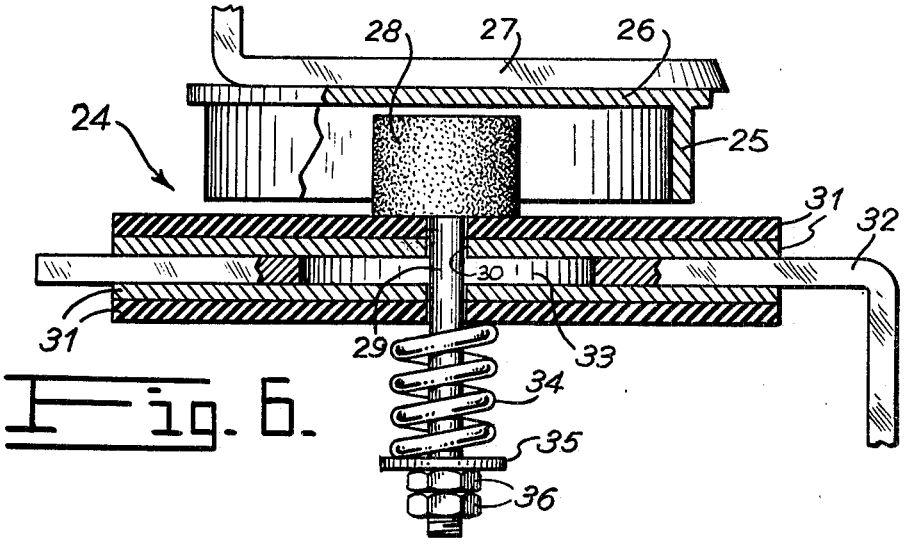
FIG. 6, is a detailed view with conventional sections, illustrating one of the shock absorbers which function when the machine is started up and stopped, to absorb the impacts of the irregular oscillation of the screen box.
Figure 7:
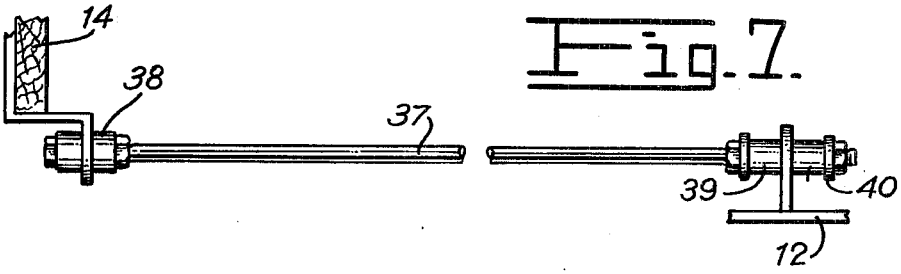
FIG. 7, is detailed view in vertical elevation with conventional sections which illustrates a stabilizing bar placed at the discharge end of the machine and which is connected at one of its end to the screen box and at the other to the frame, for stabilizing and guiding the screen.

Uniformity of oscillation of the mechanism of the present invention is reached once the counterweights 17 and 18 establish the normal stroke or eccentricity of the movement due to centrifugal force. However, when the machine is started or stopped, because of the center of gravity of the counterweights being out of phase relative to the lengthwise axis of the machine a force will be produced which thrusts the screen box 14 energetically toward the frame 12, to prevent this, the impact or shock absorbers 24 are used, which in one embodiment of the invention as shown in FIGS. 3 and 6 consist of a drum 25 faced down and firmly secured by its base 26 to screen box 14 by means of steel bars 27. Partially inside the drum 25 is cylinder 28 of an elastomeric or similar material, in which is inserted shaft 29 which passes through holes 30 in a pair of plates 31 which are clamped sandwich-style upon bar 32 which is solidly joined to frame 12. Bar 32 has a hole 33 of sufficient diameter to permit horizontal movement of shaft 29 until elastomeric body 28 bears against the inner walls of drum 25 absorbing the movement by a holding pressure between plates 31 and bar 32 by the action of coil spring 34 which surrounds the lower portion of shaft 29 and pushes it downward by bearing upon support washer 35 which is retained in its position by nut and locknut 36 threaded onto the extreme lower end of shaft 29. These shock absorbers 24 prevent the front portion of the screen box where material infeed is located from striking the frame when the mechanism is started up or stopped. Because of the centrifugal force developed by the counterweights and because of their direction of rotation there is also at the mechanism starting a slight tendency to displacement of the screen at the end opposite the counterweights. To prevent this movement, a stabilizing bar 37 is used as a retainer, having one end 38 secured to the screen box 14 and the other end 39 substantially secured to the frame 12 but able to make a slight sliding movement relative to the frame 12 limited by resilient stops 40.

Figure 2:
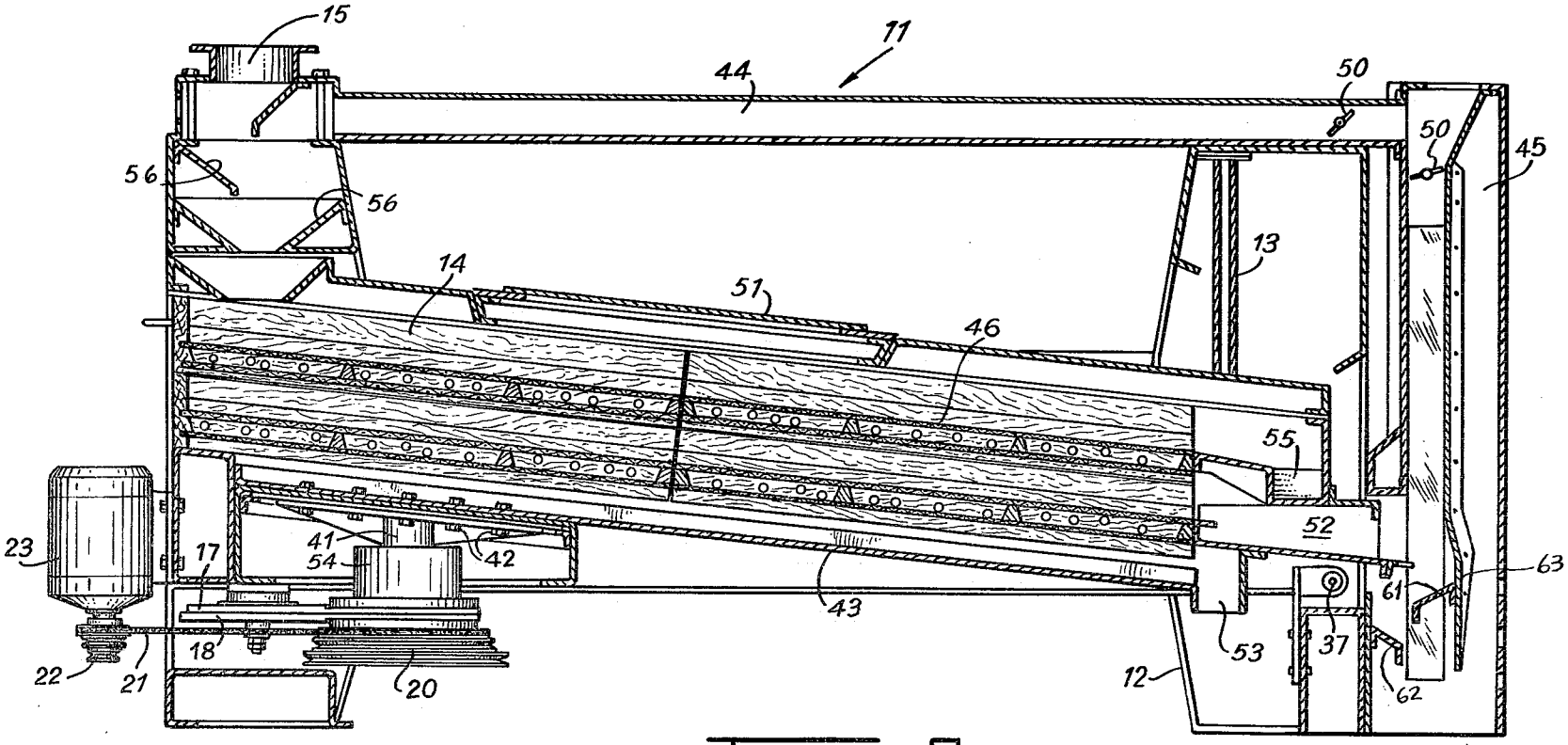
FIG. 2, is a lengthwise section view of the machine of the present invention shown in FIG. 1, showing the internal component parts thereof.

As can be seen in FIG. 2, pulley 20 has its shaft 41 secured by bolts 42 to the lower face 43 of the screen box 14, near the material feed end and said shaft 41 has a rotating hub 54 mounted thereon to which screws 19 are attached to secure and to permit movement of counterweights 17 and 18.

As shown in FIGS. 1 and 2, suction box or channel 44 is placed upon frame 12 to provide suction entry passages 15 for the material to be treated and a box or aspirating channel 45 for suction at the discharge of the material.

Interchangeable screens or sieves 46 are secured by means of wedge-shaped holders 47 fixed to screen box 14. Said suspension cables 13 are secured with pins 48 to the frame 12 and with clamps 49 to the screen box 14 to allow free oscillation of the latter.

Depending of the treating material operation, whether cleaning, screening, classification, sizing or separation and depending on the type of material, there may be required a number of combinations of screens and sieves, just as it may be necessary to stack frames 12 for vertical assembly, as illustrated in FIG. 1.

This is possible only with the apparatus of the present invention, because it does not produce shaking of the frames and therefore does not require any special foundations.

Among the structural parts which it has not been necessary to define, in describing the function and makeup of the invention are deflectors 56 in the material infeed, deflectors 61, 62, and 63 at the discharge 52 of the material, cover 51 in the middle of the screen box. Airlift or suction channels 44 and 45 including valves 50 for regulating the air flow. The discharge of the material can be effected at three different levels: first 55, for material which has not passed through the first screen, and which might be big size material or for cleaning or sizing the material; a second level 52 for material having passed through the first screen 46; and a third level 53 for material passing through second screen 46. The number of screens 46 can be whatever is desired; and when it is combined with a second similar mechanism on top of it any desired combination can be obtained.

While the foregoing description is drawn to a specific embodiment of the invention, it will be apparent that many variations may be made therein, all within the scope of the present invention as defined in the following claims.

I claim:

1. A screening and sizing machine for particulate material, comprising:

a frame;

an elongate rectangular screen box supported on the frame by means of cables to permit oscillation of the screen box;

at least one substantially planar screen mounted in the screen box and oriented with areas near one end of the screen box higher than areas near the other end of the screen box;

passage means for feeding material to be treated onto the screen at said one end of the screen box and for separately receiving at said other end of the screen box material which has passed through the screen and material which has not passed through the screen; and a mechanism connected to the screen box for imparting elliptical movement to the screen box and comprising drive means, a support shaft attached to the underside of the screen box, a hub member mounted rotatably on the support shaft, transmission means connecting the drive means to the hub member to drive the hub member to rotate about said support shaft and including a holding member releasably secured to said hub member, and first and second counterweights clamped by said holding member to said hub member for rotation therewith, said transmission means being variable, to vary the rate of rotation of said counterweights and thereby to vary the frequency of oscillation of the screen box, and said counterweights being clamped releasably to the hub member by said holding member so that the counterweights can be moved relative to one another about said hub member to vary the stroke of oscillation of the screen box, the frequency of oscillation and the stroke of oscillation being variable independently of one another, and said support shaft being attached to the screen box at a position near said one end iof the screen box and spaced apart from the center of gravity thereof whereby said one end of the screen box undergoes elliptical movement with the major axis of the ellipse extending transversely of the longitudinal axis of the screen box whereas said other end of the screen box undergoes substantially rectilinear oscillatory movement in a direction substantially parallel to said longitudinal axis.

2. A machine as claimed in claim 1, further comprising shock absorbing members to damp movement of said screen box when said machine is started and stopped, said shock absorbing members each consisting of an elastomeric body secured to said frame and partially surrounded by a drum secured to the screen box at said one end thereof.

3. A machine as claimed in claim 1, wherein said holding member is in the form of a first pulley of the transmission means, the drive means have an output shaft, and the transmission means also comprise a second pulley secured to said output shaft and a belt connecting the first and second pulleys together, at least one of said pulleys being a multiple sheave pulley, the sheaves being of different respective diameters.

* * * * *